US009188097B2

(12) United States Patent
Gray et al.

(10) Patent No.: US 9,188,097 B2
(45) Date of Patent: Nov. 17, 2015

(54) STARTER WITH SPEED SENSOR ASSEMBLY

(71) Applicant: Remy Technologies, LLC, Pendleton, IN (US)

(72) Inventors: Joel Gray, Fishers, IN (US); Kirk Neet, Pendleton, IN (US); David Fulton, Anderson, IN (US); German Holguin Pallares, Noblesville, IN (US)

(73) Assignee: Remy Technologies, LLC, Pendleton, IN (US)

( * ) Notice: Subject to any disclaimer, the term of this patent is extended or adjusted under 35 U.S.C. 154(b) by 267 days.

(21) Appl. No.: 14/035,376

(22) Filed: Sep. 24, 2013

(65) Prior Publication Data

US 2014/0260795 A1 Sep. 18, 2014

Related U.S. Application Data

(60) Provisional application No. 61/791,937, filed on Mar. 15, 2013, provisional application No. 61/789,483, filed on Mar. 15, 2013.

(51) Int. Cl.

| | |
|---|---|
| ***F02N 11/00*** | (2006.01) |
| ***F02N 15/06*** | (2006.01) |
| *F02N 11/08* | (2006.01) |

(52) U.S. Cl.

CPC ..... *F02N 11/00* (2013.01); *F02N 11/0851* (2013.01); *F02N 15/06* (2013.01); *F02N 11/0814* (2013.01); *F02N 2200/041* (2013.01);

(Continued)

(58) Field of Classification Search

CPC ..... F02N 11/00; F02N 11/0851; F02N 2300/102; F02N 2200/041; F02N 11/0814

USPC ..... 123/179.4, 179.28, 179.29, 179.25; 74/7 E

See application file for complete search history.

(56) References Cited

U.S. PATENT DOCUMENTS 4,415,812 A * 11/1983 Griffith et al. ..... 290/38 R
6,354,257 B1 * 3/2002 Marshall et al. ..... 123/179.3

(Continued)

FOREIGN PATENT DOCUMENTS

| | | |
|---|---|---|
| JP | 2002-070699 | 3/2002 |
| JP | 2004-060458 A | 2/2004 |
| JP | 2010-255523 A | 11/2010 |

OTHER PUBLICATIONS

International Search Report and Written Opinion; PCT/US2014/026233; Jul. 22, 2014; 8 pages.

*Primary Examiner* — Hai Huynh
(74) *Attorney, Agent, or Firm* — Bose McKinney & Evans LLP

(57) ABSTRACT

A starter assembly adapted for use with an engine having a flywheel and electronic control unit. The starter includes a motor, magnetic field source and a pinion gear engageable with the flywheel. An internal power train transmits torque from the armature to the pinion gear and includes a gear set dividing the internal power train into a first segment with the armature and a second segment with the pinion gear. During operation the first segment has a faster rotational speed than the second segment. A speed sensor senses the speed of the first segment and communicates it to the electronic control unit. The starter assembly can be used in a vehicle with an automatic start-stop function and facilitates the synchronizing of the pinion gear and flywheel speeds when restarting the engine. The speed sensor can take various forms and is advantageously supported on the field frame assembly proximate the commutator.

20 Claims, 4 Drawing Sheets

(52) U.S. Cl.
CPC ..... *F02N 2300/102* (2013.01); *Y10T 74/137* (2015.01)

(56) References Cited

U.S. PATENT DOCUMENTS

| | | | | |
|---|---|---|---|---|
| 6,759,756 | B2 | 7/2004 | Shiga et al. | |
| 7,218,010 | B2 * | 5/2007 | Albertson et al. | 290/38 R |
| 7,275,509 | B2 | 10/2007 | Kassner | |
| 7,665,438 | B2 * | 2/2010 | Hirning et al. | 123/179.3 |
| 8,251,034 | B2 | 8/2012 | Hashim | |
| 8,534,145 | B2 | 9/2013 | Niimi et al. | |
| 8,561,588 | B2 * | 10/2013 | Reynolds et al. | 123/179.3 |
| 2004/0020315 | A1 | 2/2004 | Vilou et al. | |
| 2010/0251853 | A1 | 10/2010 | Usami et al. | |
| 2011/0174255 | A1 | 7/2011 | Neuburger et al. | |
| 2011/0202254 | A1 | 8/2011 | Ishikawa et al. | |
| 2012/0125149 | A1 * | 5/2012 | Palfai et al. | 74/7 |
| 2012/0312123 | A1 | 12/2012 | Niimi | |

* cited by examiner

STARTER WITH SPEED SENSOR ASSEMBLY

CROSS REFERENCE TO RELATED APPLICATIONS

This application claims priority under 35 U.S.C. 119(e) of U.S. provisional patent application Ser. No. 61/791,937 filed on Mar. 15, 2013 entitled STARTER and U.S. provisional patent application Ser. No. 61/789,483 filed on Mar. 15, 2013 entitled DIAGNOSTIC SYSTEM AND METHOD FOR VEHICLE STARTER the disclosures of which are both hereby incorporated herein by reference.

BACKGROUND

The present invention relates to vehicles which include an internal combustion engine and, more specifically, to starters used with such vehicles.

Conventional internal combustion engine vehicles utilize a starter when initially starting the internal combustion engine. Typically, upon the operator closing an ignition switch, the battery powers an electrical starter motor which turns a flywheel and thereby turns the engine over. The starter provides torque to the engine for a brief period of time until the engine starts to operate normally and no longer needs assistance.

In a conventional vehicle, the starter will be used when initially starting the engine and the engine will continue to run until the operator intentionally stops the engine. Recently, however, many vehicles have begun employing a stop-start system where the electronic control unit ("ECU") of the vehicle intentionally stops the engine based upon the operating conditions of the vehicle and subsequently restarts the engine based upon operating conditions of the vehicle. This stopping and starting of the engine occurs without the operator of the vehicle actively stopping or starting the engine.

Hybrid vehicles often employ a stop-start system to temporarily stop the operation of the internal combustion engine when the vehicle is brought to a stop or when the forward propulsion of the vehicle can be entirely provided by an electric traction motor. It is also becoming increasingly desirable to provide a stop-start system in non-hybrid vehicles which are entirely reliant upon an internal combustion engine for propulsion. In such non-hybrid vehicles, the stop-start system will typically only stop the engine when the brake is being applied and the vehicle is being brought to a stop or when the vehicle is stopped. The use of a stop-start system in such vehicles will, thereby, typically turn off the engine when the vehicle is stopped and in an idling situation. By automatically turning off the engine in such idling situations, the stop-start system not only enhances fuel-economy but also reduces emissions.

In many vehicles, the starter used to initially start the engine is also used when the ECU automatically restarts the engine after stopping the engine as a part of a stop-start system. As a result, drive train systems capable of frequent start and stop conditions are becoming a requirement in modern vehicles. Frequent start-stop conditions require the starter to operate in high efficiency in cold engine crank and warm engine crank environments. The demands of frequent start-stop conditions require various components and systems that function more rapidly and more efficiently to increase reliability, reduce energy consumption and enhance the driving experience.

The start-stop system may also have "change-of-mind" capabilities wherein it is able to restart the engine very shortly after the engine was stopped and the fly-wheel is still inertially rotating. In such starter-based stop-start systems, the starter will typically have a pinion gear that is capable of engaging a rotating ring gear that is coupled with a flywheel to thereby restart the engine. Such starters may have what is referred to as a synchronized design wherein the pinion gear is engaged only when the speeds of the two gears are synchronized. A solenoid is typically used to move the pinion gear into and out of engagement with the ring gear.

Further improvements in such starter-based stop-start systems are desirable.

SUMMARY

The present invention provide a starter that can be used in a vehicle having a stop-start system which facilitates the engagement of the starter while the engine is still inertially rotating.

The invention comprises, in one embodiment, a starter assembly adapted for use with an engine having a flywheel and an electronic control unit. The starter assembly includes a starter motor with an armature and a magnetic field source; a pinion gear selectively engageable with the flywheel and an internal power train. The internal power train includes the armature and the pinion gear and extends therebetween whereby the internal power train transmits torque from the armature to the pinion gear. A gear set is disposed in the internal power train and divides the internal power train into first and second segments wherein the first segment includes the armature and the second segment includes the pinion gear. During rotation of the internal power train by the starter motor, the first segment defines a first rotational speed and the second segment defines a second rotational speed less than the first rotational speed. The starter assembly also includes a speed sensor assembly configured to sense the rotational speed of the first segment and communicate a signal representative of the rotational speed to the electronic control unit.

The speed sensor assembly may be advantageously configured to sense the rotational speed of the armature. In some embodiments, the speed sensor assembly is a magnetic flux sensor. For example, the sensor may be a Hall effect sensor. In embodiments where the armature includes a laminated sheet steel core defining a plurality of teeth, the magnetic flux sensor can be positioned to sense the rotational movement of the plurality of teeth. In other embodiments, the magnetic flux sensor is positioned to sense the rotational movement of a target wherein the target can take the form of a magnet.

In yet further alternative embodiments, the starter assembly includes a field frame assembly that includes the magnetic field source and circumscribes the armature and the magnetic flux sensor is an inductive loop supported on the field frame assembly proximate the armature. Such an inductive loop may advantageously have an axial length that is larger than its circumferential width in a starter assembly that has an armature with a plurality of teeth defining slots therebetween wherein the slots define circumferential gaps and the circumferential width of the inductive loop is approximately the same as the circumferential gaps defined by the slots.

In still other embodiments, the speed sensor assembly includes an optical sensor. Alternatively, the speed sensor assembly may include a current sensor. In yet other embodiments, the speed sensor assembly may include a temperature sensor and a battery voltage sensor.

In yet other embodiments, the starter assembly comprises a plurality of brushes in contact with a commutator on the armature and the speed sensor assembly includes an auxiliary brush in contact with the commutator. In some embodiments, the commutator includes at least one non-conductive element positioned to periodically face the auxiliary brush as the commutator rotates and thereby break conductive contact between the auxiliary brush and commutator.

The invention comprises, in another form thereof, an automatic stop-start system for a vehicle having an internal combustion engine with a flywheel. The automatic stop-start system includes an electronic control unit, a battery and a starter operably coupled to the electronic control unit and the battery. The starter includes a starter motor with an armature and magnetic field source wherein the armature includes a commutator disposed at one end thereof. A field frame assembly that includes the magnetic field source circumscribes the armature. A pinion gear is drivingly coupled with the armature wherein the pinion gear and commutator are disposed on opposite axial ends of the armature. The pinion gear is selectively engageable with the flywheel. An internal power train including the armature and the pinion gear and extending therebetween transmits torque from the armature to the pinion gear. A gear set is disposed in the internal power train and divides the internal power train into first and second segments wherein the first segment includes the armature and the second segment includes the pinion gear. During rotation of the internal power train by the starter motor, the first segment defines a first rotational speed and the second segment defines a second rotational speed that is less than the first rotational speed. The starter assembly also includes a speed sensor assembly configured to sense the rotational speed of the first segment and communicate a signal representative of the rotational speed to the electronic control unit. The speed sensor assembly is supported on the field frame assembly proximate the commutator.

DESCRIPTION OF THE DRAWINGS

The above mentioned and other features of this invention, and the manner of attaining them, will become more apparent and the invention itself will be better understood by reference to the following description of embodiments of the invention taken in conjunction with the accompanying drawings, wherein.

Figure 1:
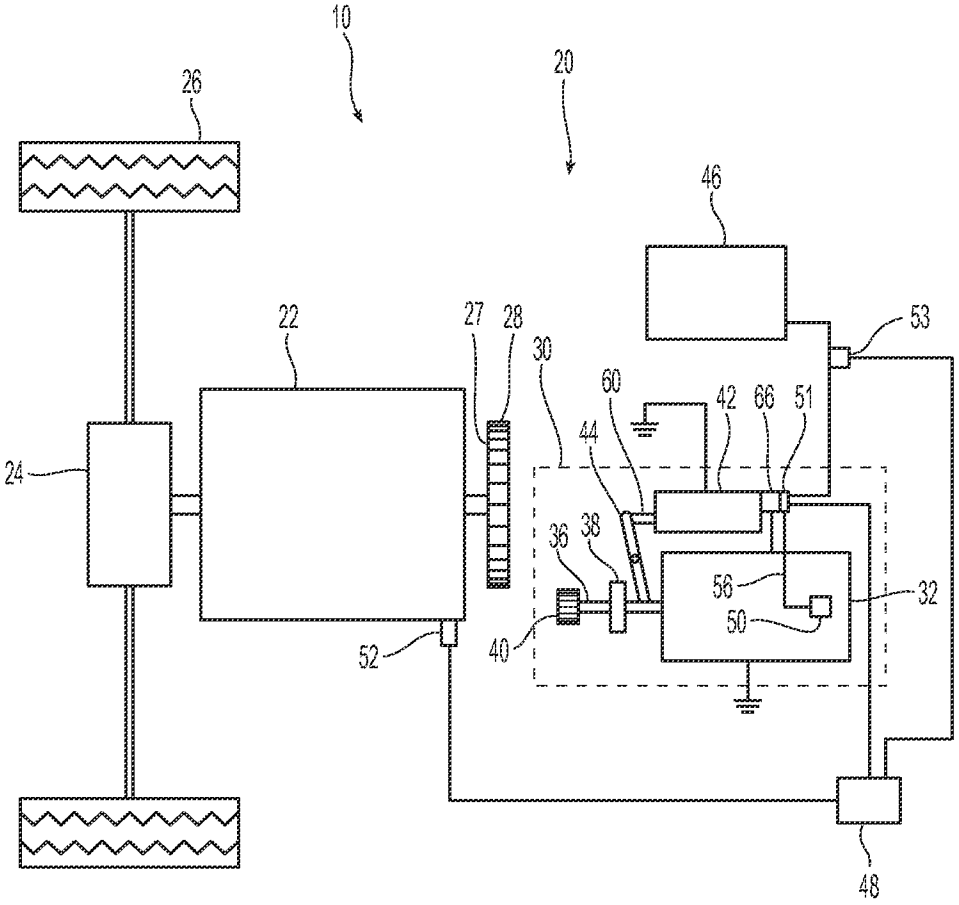
FIG. 1 is a schematic illustration of a vehicle having a starter-based automatic start-stop system.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION

FIG. 1 schematically depicts a vehicle 10 with a starter-based stop-start system 20. Vehicle 10 includes an internal combustion engine 22 and a drivetrain 24 that transmits torque from engine 22 to driven wheels 26. In the illustrated embodiment, the outer circumference of flywheel 27 takes the form of a ring gear 28. Flywheel 27 is coupled to the drive shaft of engine 22. Although the depicted vehicle 10 is a front-wheel drive passenger car, the start-stop system and method disclosed herein can be used with a wide variety of other vehicles. It may also be used with engines that are stationary or which are the not used to power the driven wheels of a vehicle.

Starter assembly 30 is used to rotate flywheel 27 when starting engine 22. Starter assembly 30 includes an electric motor 32 having an armature 70 and field frame assembly 72. The armature 70 includes a commutator 74 which is engaged by a plurality of carbon brushes 76. Brushes 76 and commutator 74 allow for the communication of electrical current between windings 78 on rotating armature 70 and the stationary brushes 76. The armature windings 78 and commutator 74 are mounted on a shaft 34 which is coupled to a pinion shaft 36 by a gear set 80 and an overrunning clutch 38.

Field frame assembly 72 includes a laminated sheet steel core and a magnetic field source 73 such as field coils or permanent magnets. Field frame assembly 72 also includes an outer casing and supporting bracketry mounted therein. The illustrated starter motor operates in a conventional manner with the field coils and/or magnets forming a stationary electromagnetic field. As the armature rotates, the commutator segments contact different brushes and reverse polarity to thereby cause the continued rotation of the armature. The field coils and armature windings may form a series motor, a shunt motor or a compound motor as is well understood by those having ordinary skill in the art. Or, as mentioned above, field frame assembly 72 could utilize permanent magnets instead of field coils.

A pinion gear 40 is mounted on pinion shaft 36 and is selectively engageable with ring gear 28. Pinion gear 40 is shifted into and out of engagement with ring gear 28 by solenoid 42 which acts on shaft 34 through a linkage assembly that includes shift lever 44. Gear reduction drive 80 is employed between pinion gear 40 and armature 70. For example, it is known to use a gear set between the armature and pinion to reduce the rotational speed and increase the torque output by the motor to thereby allow for the use of smaller, higher speed motors. A conventional car battery 46, or other suitable source of electrical current, is used to provide electrical current to starter motor 32 and solenoid 42.

With regard to gear set 80, it is noted that starter motor 32 may operate at conventional starter motor speeds or operate at a higher speed operation which is becoming more common in modern vehicles. Higher speed motors allow for the use of smaller more efficient motors. These high speed starters can have ring gear to pinion gear ratios reaching 10-15:1 in advanced designs with an internal gear ratio of 3.6-5:1. Armature speeds of the starter can reach into the 30,000+ RPM range, and these high speeds can place significant demands on the starter design. Moreover, when deployed in an automatic start-stop system, the starter will be deployed more frequently and may be required to provide lifetime operational range of 300,000 to 400,000 start cycles.

It is noted that FIG. 1 is a schematic drawing and has been simplified to provide greater clarity in understanding the present invention. For example, a control circuit that includes the ignition switch of the vehicle and a neutral safety switch which prevents the ignition switch from activating the starter motor while the vehicle is in gear is not shown. Vehicle 10 also includes an electronic control unit ("ECU") 48 that controls the operation of starter motor 32 and solenoid 42 by means of relays or other suitable switching mechanisms. In the illustrated embodiment, a motor relay 66 is positioned adjacent solenoid 42. ECU 48 controls the operation of relay 66 to selectively energize and de-energize motor 32 independently of the status of solenoid 42.

Relay 66 is used to selectively open and close a circuit connecting battery 46 with motor 32 and thereby selectively de-energize and energize motor 32. The use of relays to selectively energize a starter motor is well known to those having ordinary skill in the art. Although the illustrated embodiment utilizes relay 66 to selectively energize motor 32 alternative switching mechanisms may also be employed to selectively energize motor 32 independently of solenoid 42.

As can be seen in FIG. 1, ECU 48 is also in communication with a starter speed sensor assembly 50 which measures the rotational speed of a part of starter 30. ECU 48 is also in communication with engine sensors 52 which may include a sensor for measuring engine speed and, thus, allows for the determination of the rotational speed of flywheel 27 and ring gear 28. Alternatively, a sensor may directly measure the flywheel 27 and ring gear 28 speed. ECU 48 also receives signals indicative of the status of the accelerator and brake (not shown) as well as other vehicle systems as will be readily appreciated by a person having ordinary skill in the art. For example, other vehicle sensors may include a battery voltage sensor 53.

Turning now to the operation of starter 30, when starting engine 22, starter motor 32 is activated and pinion gear 40 is engaged with ring gear 28 to thereby rotate flywheel 27 of engine 22 and provide the initial torque necessary to start engine 22. If ring gear 28 is still inertially rotating when it is desired to start engine 22, sensors 50, 52 are used to measure the rotational speed of ring gear 28 and armature 70. ECU 48 actuates motor 32 without actuating solenoid 42 and determines the speed of pinion gear 40 based upon the sensed speed of armature 70. When the rotational speeds of pinion gear 40 and ring gear 28 are sufficiently similar, ECU 48 actuates solenoid 42 to extend pinion 40 into engagement with ring gear 28.

For example, in a stop-start system, a vehicle operator may be coming to a stop at a traffic light and the light may change just as the vehicle is being stopped and the stop-start system has stopped engine 22. In such a case, where the operator releases the brake and depresses the accelerator almost immediately after engine 22 has stopped running, flywheel 27 will still be rotating due to inertia and pinion gear 40 will need to mesh with a rotating ring gear 28. Other "change-of-mind" situations will also be encountered by stop-start systems where engine 22 will need to be restarted before ring gear 28 has stopped rotating. In such a system employing a "synchronized" starter, once the rotational speeds of ring gear 28 and pinion 40 are sufficiently synchronized, solenoid 42 is actuated to bias pinion gear 40 into engagement with ring gear 28.

Once the engine begins running, pinion gear 40 is disengaged from ring gear 28. Before disengagement of pinion gear 40, however, it is possible for the engine speed to exceed that of the starter motor 32. Overrunning clutch 38 prevents damage to starter motor 32 in such a situation. Overrunning clutch 38 transmits torque from starter motor 32 to pinion gear 40 but freewheels in the opposite direction preventing the ring gear 28 from transmitting torque to the starter motor 32. Consequently, if engine 22 is running at a higher rotational speed than starter motor 32 while pinion gear 40 is engaged with ring gear 28, overrunning clutch 38 will allow pinion shaft 36 and pinion gear 40 to rotate at a faster speed than the armature of the starter motor 32. The use of an overrunning clutch between a starter motor and a ring gear is known to those having ordinary skill in the art and the illustrated overrunning clutch 38 operates in a conventional manner to prevent the transmission of torque from ring gear 28 to starter motor 32.

As mentioned above, solenoid 42 is used to shift the position of pinion 40 into and out of engagement with ring gear 28 using shift lever 44. At one end, shift lever 44 is pinned to plunger 60 of solenoid 42 or to a projection extending from plunger 60. Shift lever 44 is pivotally mounted near its midpoint to the starter frame and has its second end coupled with collar 54 disposed on pinion shaft 36. When plunger 60 is pulled into solenoid 42, shift lever 44 is pivoted about its midpoint and biases pinion gear 40 into engagement with ring gear 28.

When the collar is shifted toward ring gear 28, overrunning clutch 38 and pinion 40 will also be shifted toward ring gear 28. If the teeth of pinion 40 do not initially mesh with the teeth of ring gear 28, a jump spring (not shown) disposed in the linkage system between pinion gear 40 and solenoid 42 will become depressed and exert a biasing force on pinion 40 toward ring gear 28. Once the teeth of the two gears are aligned to allow for the engagement of pinion 40 with ring gear 28, the spring will bias pinion 40 into engagement with ring gear 28. A stop on shaft 34 limits the travel of and positively engages the sliding collar in the opposite direction when solenoid 42 is de-energized and lever 44 biases the collar away from ring gear 28 and disengages pinion gear 40. The use of such a collar and jump spring is well-known to those having ordinary skill in the art.

Solenoid 42 includes windings or coil 62 which attract plunger 60 when coil 62 is energized. Once coil 62 has been de-energized, a return spring 64 biases plunger 60 outwardly. In addition to the use of a single coil to form the solenoid windings, alternative embodiments may employ two separate coils in the form of a pull-in winding and a hold-in winding. In a solenoid having two separate windings, the pull-in and hold-in windings may have approximately the same number of turns with the pull-in winding formed out of a heavier wire whereby it draws more current and creates a stronger electromagnetic field. When it is desired to retract or pull-in plunger 60, both windings would be energized. Once plunger 60 has been fully retracted, a disc on plunger 60 will contact a terminal and the pull-in winding would be de-energized. The electromagnetic field of the hold-in winding is not sufficiently strong to draw plunger 60 in, but it is sufficient to hold plunger 60 in its retracted position once it has been drawn in by the combined action of the pull-in and hold-in windings. Once the hold-in winding has been de-energized, return spring 64 would bias plunger 60 outwardly.

Gear set 80 is also disposed within starter assembly 30 and divides internal power train 82 into two segments 84, 86. Internal power train 82 is formed by the rotating parts of starter assembly 30 and both extends between and transmits torque from armature 70 to pinion gear 40. First segment 84 of power train 82 includes armature 70 while second segment 86 on the opposite side of gear set 80 includes pinion gear 40. Gear set 80 is a reducing gear and, thus, when motor 32 is operating, first segment 84 with motor 32 will rotate faster than second segment 86 with pinion gear 40. In other words, during operation, first segment 84 defines a first rotational speed and second segment 86 defines a second rotational speed that is less than the first rotational speed.

As mentioned above, vehicle 10 has a stop-start system 20. As a part of the stop-start system, ECU 48 is programmed to stop the operation of engine 22 when certain operating parameters are met and subsequently restart engine 22 based upon operating parameters of the vehicle. For example, if the operator of the vehicle is applying the brake and the speed of the vehicle is at or approaching zero and certain other vehicle parameters are satisfied, e.g., the temperature of the engine is within a predetermined range, ECU 48 will stop the operation of engine 22. ECU 48 will subsequently restart engine 22 as a function of the vehicle operating parameters. For example, if the operator removes their foot from the brake pedal or upon another change in vehicle operating conditions, e.g., the battery voltage falls below a predefined limit, ECU 48 will restart engine 22.

When restarting engine 22, ECU 48 will first determine if the engine is stopped or is still coasting. If the engine has stopped and flywheel 27 is no longer rotating, engine 22 will be restarted in the same manner that it is started in an operator initiated key-start. In a key-start, the pinion 40 is engaged with ring gear 28 either before or simultaneously with the activation of starter motor 32. In other words, ECU energizes solenoid 42 slightly before or substantially simultaneously with motor relay 66. If sensor 52 indicates that engine 22 is still coasting and ring gear 28 is rotating, starter motor 32 is energized first and only after the rotational speeds of ring gear 28 and pinion gear 40 are sufficiently synchronized is solenoid 42 energized to engage pinion gear 40 with ring gear 28 and restart engine 22 as described in greater detail below.

One or more speed sensor assemblies 50 are used to sense the rotational speed of first segment 84 of internal power train 80 and communicate a signal representative of this speed to ECU 48. ECU 48 uses this information in combination with data already available in engine control systems that is representative of the ring gear speed to determine if the speed of pinion 40 is sufficiently synchronized with flywheel 27 to engage pinion 40 with ring gear 28 when restarting engine 22.

Because sensor assemblies 50 sense the rotational speed of first segment 84 instead of second segment 86, the sensor assembly must sense the higher of the two rotational speeds. While this higher rotational speed can be more demanding for some sensor assemblies, this arrangement allows the sensor assembly to be supported on the field frame assembly proximate relay 66 where a connector 51 is located. Connector 51 provides communication between sensor 50 and ECU 48 via wiring 49. This positioning of sensor assembly 50 allows the length of wiring 56 between sensor assembly 50 and connector 51 to be minimized. Wiring 56 includes communication wiring and any required power wiring for sensor assembly 50. By minimizing wiring 56, the reliability of starter assembly 30 is enhanced by reducing the possibility of fraying or other damage to wiring 56. For example, if wiring 56 extended for a longer distance within starter assembly 30 to directly sense the rotational speed of second segment 86 of internal power train 82, the possibility of such wiring being frayed by contact with a moving part or having its functionality impaired by electromagnetic interference would be increased.

Several different embodiments of sensor assemblies 50 will now be discussed. Generally, it will be advantageous to utilize only one of the different sensor assemblies described herein to sense the rotational speed of the starter assembly. However, the use of multiple sensor assemblies can also be advantageous, for example, to provide a back-up sensing capability. Furthermore, some of the sensor assemblies described herein for sensing the rotational speed of starter assembly 30 have a dual function sensing other operating parameters of the vehicle and such dual function sensors could be advantageously employed as a back-up sensor for a primary sensor assembly or to verify the working condition of the primary sensor assembly.

Figure 2:
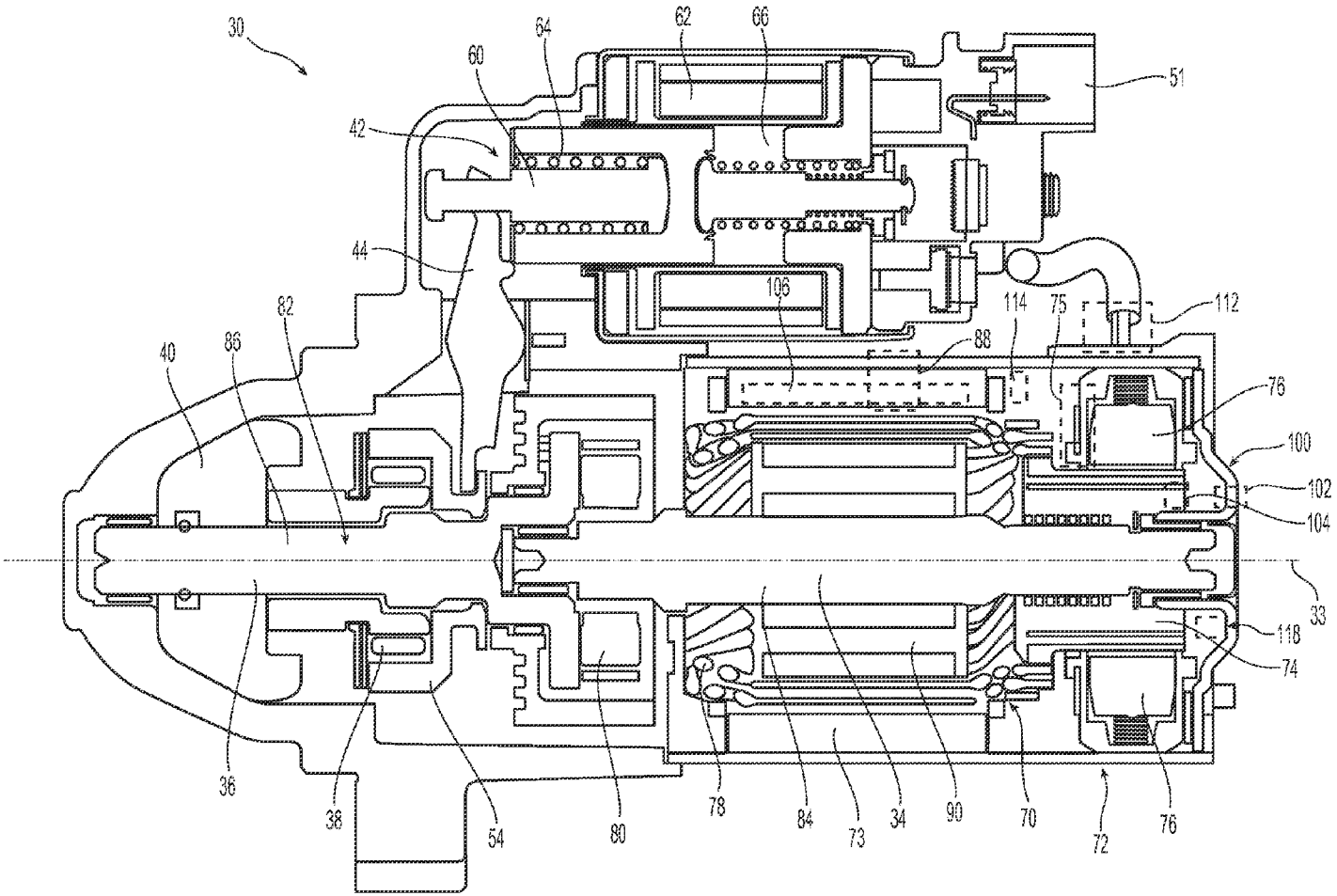
FIG. 2 is a view of starter assembly suitable for use in a starter-based automatic start-stop system.
Figure 3:
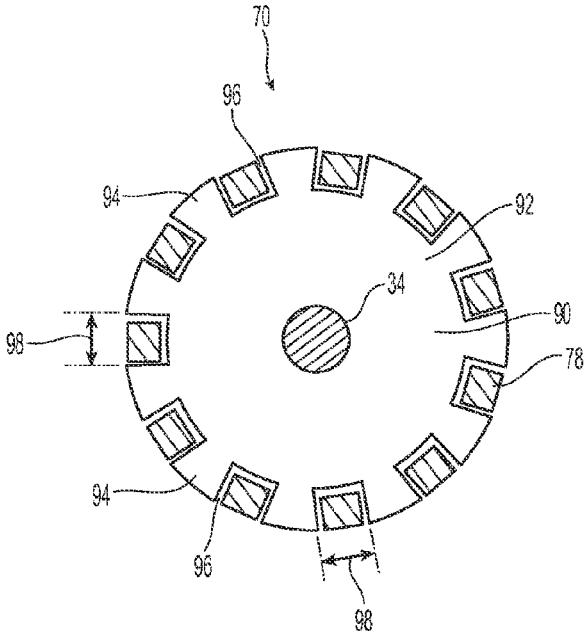
FIG. 3 is an end view of an armature.
Figure 4:
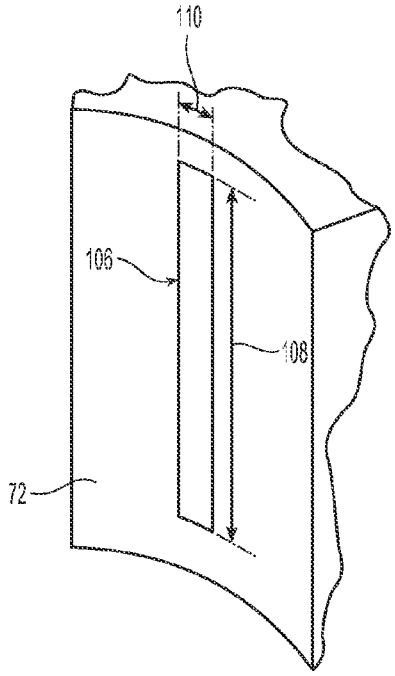
FIG. 4 is a schematic depiction of an inductive coil for sensing the rotational speed of an armature.

One embodiment of the sensor assembly takes the form of a magnetic flux sensor such as a Hall effect sensor or a Helmholtz coil. In FIG. 2, a magnetic flux sensor 88 is represented by a dashed line box and illustrates one location where such a sensor could be positioned to sense the rotational speed of armature 70. Sensor 88 could be used detect one or more targets, e.g., magnets, mounted on armature 70. In the illustrated embodiment, however, sensor 88 is used to detect features already present on armature 70. FIG. 3 provides a simplified and schematic end view of armature 70.

In the illustrated embodiment, armature 70 includes a core 90 which is formed out of a stack of sheet steel laminas 92 to form a laminated sheet steel core. As will be understood by a person having ordinary skill in the art, the individual laminas lie in a plane perpendicular to the axis of rotation 33 of armature 70 and, thus, only a single lamina is shown in FIG. 3. Core 90 is mounted on shaft 34 and defines a plurality of radially outwardly extending teeth 94. Teeth 94 define slots 96 therebetween to receive windings 78. Armature windings 78 are shown in a simplified manner in FIG. 3. As can be seen in FIG. 3, slots 96 define a circumferential gap 98 between adjacent teeth 94. Because teeth 94 are formed out of a ferromagnetic material, i.e., steel in the illustrated embodiment, and are separated by air gaps 98, magnetic flux sensor 88 can sense the passage of individual teeth 94 as armature 70 rotates. This allows sensor 88 to communicate a signal to ECU 48 representative of the rotational speed of armature 70.

Sensor assembly 100 provides another example of a magnetic flux sensor. Assembly 100 includes a sensor 102 and a target 104. Sensor 102 is a Hall effect sensor and target 104 takes the form of a magnet embedded in armature 70. Although only a single target 104 is depicted in the illustration, a plurality of such targets could also be employed. While the use of an embedded magnet to provide a target for the sensor does require additional manufacturing steps related to the installation of the magnet, one advantage of such an approach is that it allows the sensor to be positioned at a larger variety of locations as exemplified by the positioning of target 104 at the axial end of armature 70.

The sensor target may take any number of different forms. As exemplified by target 104, the target may be a magnet which may be either a permanent magnet or a electromagnet such as a magnetic coil. Alternatively, the target may be formed by creating a void in a part of the armature or embedding a non-magnetic material in a component of armature that is formed out of a ferrous metal or otherwise creating a magnetically distinguishable feature by positioning different materials and/or voids to periodically rotate past the sensor wherein the different materials and/or voids have different magnetic properties. Such targets can be integrally formed in, embedded, secured, or otherwise coupled to armature 70 so that the target passes the sensor at a rate corresponding to the rotational speed of armature 70. As mentioned above, a single target or multiple targets can be employed. For example, four targets could be positioned on the armature with one target passing the sensor for each 90 degrees of rotation of armature about axis 33.

The sensor target may also take the form of a functional element already present on armature 70. For example, the plurality of teeth 94 with slots 96 positioned therebetween act as targets for sensor 88 and also for sensor 106 described below. Teeth 94 and slots 96 are used to support and position windings 78 and are not present for the sole purpose of being sensed. Similarly, other functional components of armature 70 that are not typically used as a sensor target or which have a primary function other than acting as a sensor target but have the appropriate magnetic properties to function as a target could be employed as a sensor target for a magnetic flux sensor. It is still further noted that such inherent targets can also be enhanced by choosing materials or otherwise modifying the design of armature 70 to enhance the detectability of the functional component.

Another example of a magnetic flux sensor assembly is provided by inductive loop 106 which is supported on field frame assembly 72 proximate armature 70. In the illustrated embodiment, inductive loop 106 has an axial length 108 which is larger than its circumferential width 110. Circumferential width 110 is approximately the same dimension as the circumferential gaps 98 between teeth 94. By using an axially extending loop 106 having a circumferential width 110 that is approximately the same or less than gaps 98 and which extends parallel to rotational axis 33, at one point when a slot rotates past loop 106, loop 106 will be positioned radially outwardly of a slot 96 without any part of loop 106 being positioned directly radially outwardly of a tooth 94. This configuration also allows the size of loop 106 to be relatively large to further enhance performance. This design enables the generation square, or near-square voltage signals, thereby facilitating ease and accuracy of signal measurement.

An alternative form of sensor can take the form of a brush which contacts commutator 74. Starter assembly 30 includes a plurality of carbon brushes 76 which contact commutator 74 to conduct electrical current between the rotating armature and stationary brushes. The use of carbon brushes and commutators to periodically reverse the current direction between the armature and the external circuit of a starter motor is well known in the art. Commutators typically have a plurality of contact segments or brush bars which periodically contact each of the brushes as the segment rotates and repeatedly passes each of the brushes.

To provide a sensor for determining the rotational speed of the armature 70, an auxiliary brush 75 is also positioned to engage contact segments 77. Auxiliary brush 75 is schematically depicted in FIG. 3 and is distinct from conventional brushes 76. In this embodiment, electrical current to windings 78 is still provided by brushes 76 engaging contact segments 77 in a conventional manner. Auxiliary brush 75 is in electrical communication with the individual contact segments 77 as each segment 77 rotates past auxiliary brush 75 but this contact between segments 77 and brush 75 is only for the measuring of voltage or other electrical current parameter and does not provide for the communication of electrical current for the operation of windings 78. Because auxiliary brush 75 does not communicate current for the operation of windings 78, it can be smaller than power communicating brushes 76. Similar to brushes 76, brush 75 is biased into contact with commutator 74 with a spring. As commutator 74 rotates relative to brush 75 and individual contact segments 77 engage and disengage brush 75, the voltage signal will vary with the rotational speed of commutator 74 allowing the speed to be determined.

Figure 5:
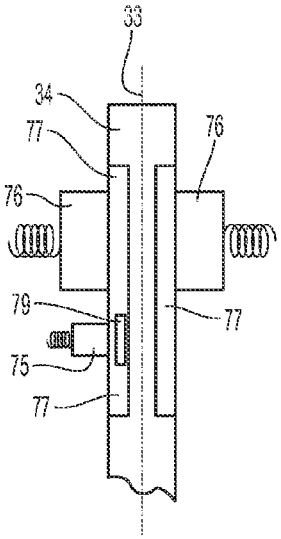
FIG. 5 is a schematic depiction of an auxiliary brush for sensing the rotational speed of an armature.

When employing an auxiliary brush 75 as a sensor, it may be possible to place brush 75 at the same axial location as brushes 76. Alternatively, brush 75 may be axially displaced relative to brushes 76 as depicted in FIGS. 3 and 5. FIG. 5 also schematically depicts a structural feature 79 which enhances the performance of brush 75. The structural feature 79 is configured to interrupt electrical communication between commutator 74 and brush 75. For example, feature 79 may prevent brush 75 from engaging a contact segment 77 and take the form of an obstrusion, a depression, an indentation or other structure such as a non-conductive surface layer material which engages brush 75 at one or more circumferential locations on commutator 74. As brush 75 encounters structure 79, the voltage signal provided by brush 75 will be interrupted and provide a more easily discernible signal pattern for determining the rotational speed of armature 70.

In yet another embodiment, structure 79 could be located at the same axial location as brushes 76 and auxiliary brush 75 could be omitted. In this embodiment, a voltage signal from one of the brushes 76 would be used to determine the rotational speed of armature 70. It will, however, generally be advantageous to position structure 79 at an axial location where it will not engage brushes 76 and use an auxiliary brush 75 instead to thereby avoid the potentially negative impact of structure 79 on the performance of brushes 76. In some applications, e.g., where minimizing the size of starter assembly 30 is a priority, such an embodiment where structure 79 engages brushes 76 could be advantageously deployed.

Another embodiment of a speed sensor is provided by current sensor 112. Current sensor 112 is arranged to sense the current on the lead wire communicating electrical current from battery 46 to brushes 76. For some starter assemblies, this "inrush current" is directly correlated to the rotational speed of armature 70 thereby allowing current sensor 112 to function as a speed sensor. In still other embodiments, the use of such a current sensor could be done in combination with another more direct measure of the armature speed. A significant advantage of current sensor 112 is the ability to locate sensor 112 at the point where electrical current enters field frame assembly 72 proximate armature 70 as depicted in FIG. 3.

In a related embodiment, instead of using a current sensor to determine the rotational speed of armature 70, a temperature sensor 114 and a voltage sensor 53 are used. Temperature sensor 114 is positioned to sense the temperature of motor 32 while voltage sensor 53 senses the voltage of battery 46. Most vehicles will have a battery voltage sensor 53 which provides ECU 48 with a signal representative of the battery voltage. Thus, for this embodiment, starter assembly 30 would typically only require a temperature sensor 114 which would then be used in combination with the battery voltage sensor 53 provided separately. Because resistance varies with temperature, the combination of a temperature reading and a voltage reading can be used to provide a signal representative of the current supplied to motor 32. As discussed above with reference to current sensor 112, the current signal could then be correlated to the armature speed for many starter assemblies. As with the current sensor 112, this sensor arrangement could be employed alone or in combination with a sensor assembly that more directly measured the rotational speed of armature 70.

Figure 6:
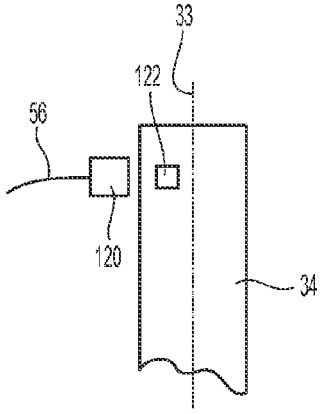
FIG. 6 is a schematic depiction of an optical sensor assembly for sensing the rotational speed of an armature.

In still another alternative embodiment, the speed sensor may take the form of an optical sensor assembly 118. In FIG. 6, sensor assembly 118 includes a combined optical emitter and sensor device 120 and a target 122 disposed on shaft 34 proximate commutator 74. In the illustrated embodiment, optical sensor device 120 functions both as a light source and a light sensor. The optical emitter may take the form of an LED or other light source such as an optical fiber, a laser such as a semiconductor laser or other conventional laser, an infrared source, a UV source, or a radioactive source. The optical sensor may comprise a photodiode, a phototransistor, a camera, or other type of electro-optical sensor. Although the optical emitter and optical sensor are combined in a single sensor housing in the illustrated embodiment, these two functions can be separated in alternative embodiments. For example, optical sensor 120 could be either the emitter or sensor and target 122 could be the other.

In the illustrated embodiment target 122 is a reflective target having reflective properties which differ from the surrounding material. As a result, light emitted from housing 120 will be reflected back and detected by the sensor in housing 120. In the illustrated embodiment, target 122 is more reflective than the surrounding material, however, the detection of target 122 could also be accomplished if it were less reflective. The frequency with which the passage of target 122 is detected is then correlated to the speed of armature rotation. It is also noted that while FIG. 6 illustrates only a single target, multiple targets could be employed.

In addition to reflective targets, other forms of optical targets can also be employed when using an optical sensor assembly. For example, target 122 could take the form of a passive optical emitting material, such as a phosphorescent or fluorescent material. It is further noted that in some embodiments the optical emitter and optical sensor could be arranged to define a path such that a functional component on armature 70 periodically interrupts the path without any portion of optical sensor assembly 120 being positioned on armature 70. Alternatively, a structure which periodically interrupts the light path could be attached to armature 70 for the sole purpose of interacting with sensor assembly 118. Furthermore, in some embodiments it may be possible for a functional component on armature 70 to act as a reflective target 122.

Figure 7:
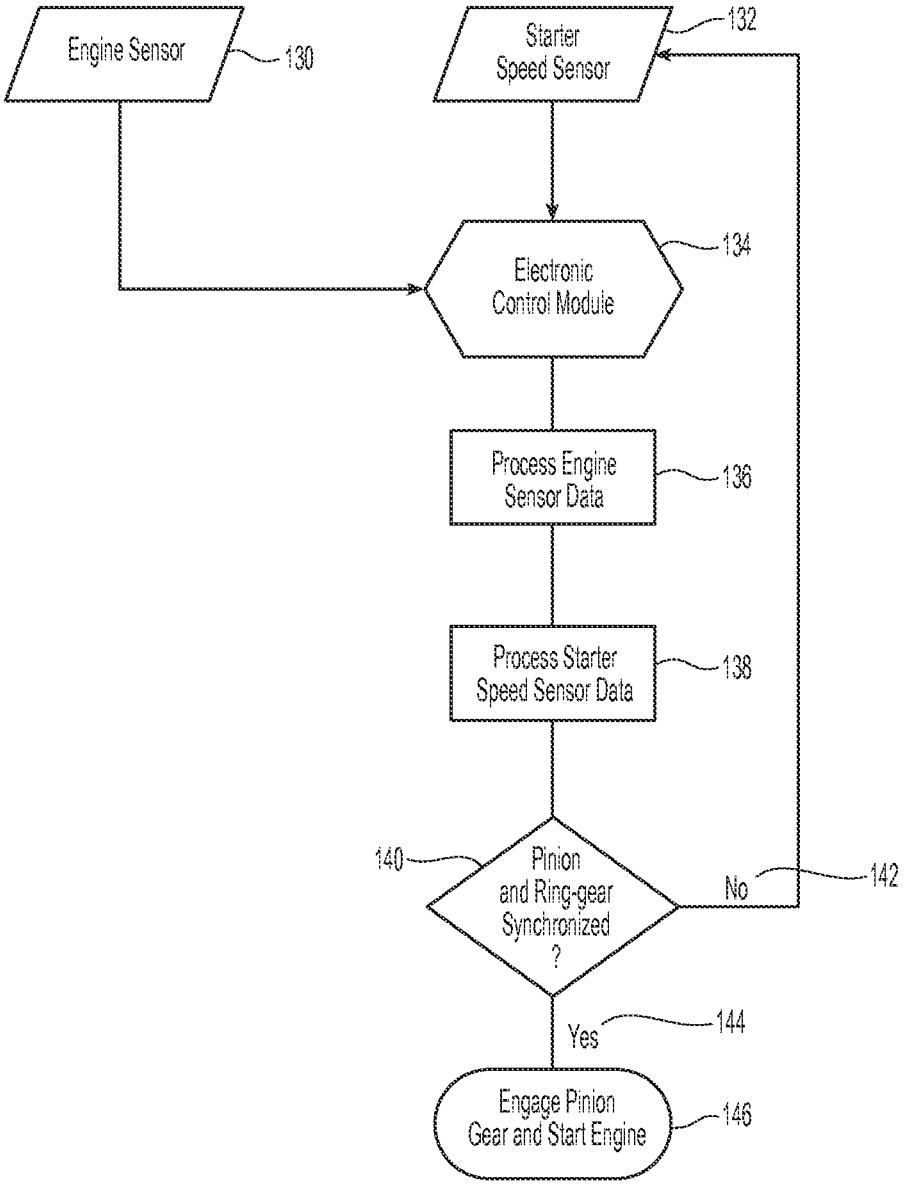
FIG. 7 is a flowchart of a method for restarting an engine with a starter-based automatic start-stop system.

A flowchart illustrating the operation of starter assembly 30 is presented in FIG. 7. Engine sensors 52 and other vehicle system sensors, such as battery voltage sensor 53, communicate data to ECU 48 as represented by boxes 130 and 134. Similarly, speed sensor assembly 50 communicates data to ECU 48 as represented by boxes 132 and 134. The communication of data to ECU 48 represented by boxes 130, 132 and 134 may be continuously, periodically, or upon request.

After communication to ECU 48, this data is processed by ECU 48. The engine sensor data is used to determine the rotational speed of ring gear 28 as represented by box 136 and the speed sensor assembly data is used to determine the rotational speed of pinion gear 40 as represented by box 138. It is noted that when making these determinations, the actual rotational speeds of ring gear 28 and pinion gear 40 are not necessarily calculated but a value representative of such speeds is determined. When processing the data received from speed sensor assembly 50, the reduction in rotational speed due to gear set 80 is accounted for before reaching the determination represented by box 140 where the rotational speeds of pinion gear 40 and ring gear 28 are compared. Furthermore, the ring gear 28 and pinion gear 40 ratio must also be accounted for when comparing the rotational speeds of the ring gear 28 and pinion gear 40.

Box 140 represents the comparison of the rotational speeds of ring gear 28 and pinion gear 40. If the rotational speeds are sufficiently similar to allow for the engagement of pinion gear 40 with ring gear 28, solenoid 42 is actuated and pinion gear 40 is extended into engagement with ring gear 28 as represented by "YES" determination 144 and box 146. With pinion gear 40 and ring gear 28 are engaged, relay 66 continues to energize starter motor 32 and fuel is introduced into engine 22 to start engine 22 as also represented by box 146. It is noted that when comparing the rotational speeds of ring gear 28 and pinion gear 40, the speeds will not have to be identical but there will be a permissible difference in speed that will still allow for the engagement of pinion gear 40 with ring gear 28. The magnitude of this permissible difference in rotational speed will depend in part on the design of ring gear 28 and pinion gear 40 and will vary for different vehicles and applications.

When conducting the first pass through the process, starter motor 32 will initially be de-energized. If the initial determination shows that engine 22 is stopped and ring gear 28 is not rotating or rotating only at a minimum value less than the permissible difference in rotational speeds between ring gear 28 and pinion gear 40, the pinion gear 40 can be engaged and motor 32 energized substantially simultaneously to start engine 22 in a manner similar to a key-start.

If the difference in rotational speeds exceeds the permissible difference, when a comparison is made at box 140, a "NO" determination 144 is made and the process is repeated until the pinion gear and ring gear are synchronized. A decision regarding actuation of motor 32 is also made when a NO determination 144 is reached. If the ring gear speed exceeds the pinion gear speed and motor 32 is de-energized, motor 32 will be energized. If the pinion gear speed exceeds the ring gear speed and motor 32 is energized, it will be de-energized. In some embodiments, one or both of these actions are taken only after a predetermined number of determinations are made.

It is further noted that the sensor assemblies described herein may have conventional circuitry to reduce noise in the signal communicated to ECU 48. It is also possible to provide the sensor assemblies with greater processing capabilities and convert the signal whereby it represents a potential pinion gear speed or otherwise provides some processing or control functions that were described as being conducted by ECU 48 above. By shifting some of the processing to the sensor assembly, starter assembly 30 could be specifically designed to work with the ECU of a particular vehicle wherein that ECU was not originally programmed to work with starter assembly 30.

While this invention has been described as having an exemplary design, the present invention may be further modified within the spirit and scope of this disclosure. This application is therefore intended to cover any variations, uses, or adaptations of the invention using its general principles.

What is claimed is:

1. A starter assembly adapted for use with an engine having a flywheel and an electronic control unit, the starter assembly comprising:

a starter motor with an armature and a magnetic field source;

a pinion gear selectively engageable with the flywheel;

an internal power train including the armature and the pinion gear and extending therebetween wherein the internal power train transmits torque from the armature to the pinion gear;

a gear set disposed in the internal power train and dividing the internal power train into first and second segments wherein the first segment includes the armature and the second segment includes the pinion gear and wherein, during rotation of the internal power train by the starter motor, the first segment defines a first rotational speed and the second segment defines a second rotational speed less than the first rotational speed; and a speed sensor assembly configured to sense the rotational speed of the first segment and communicate a signal representative of the rotational speed to the electronic control unit.

2. The starter assembly of claim 1 further comprising a shift lever coupling the pinion gear with a first solenoid, the first solenoid selectively biasing the pinion gear into and out of engagement with the flywheel by movement of the shift lever; and a relay disposed to selectively energize and de-energize the starter motor; the first solenoid and relay being operable independently of each other.

3. The starter assembly of claim 1 wherein the speed sensor assembly is configured to sense the rotational speed of the armature.

4. The starter assembly of claim 1 wherein the speed sensor assembly comprises a magnetic flux sensor.

5. The starter assembly of claim 4 wherein the armature comprises a laminated sheet steel core defining a plurality of teeth and wherein the magnetic flux sensor is positioned to sense the rotational movement of the plurality of teeth.

6. The starter assembly of claim 4 wherein the armature further comprises at least one target disposed thereon and the magnetic flux sensor is positioned to sense the rotational movement of the at least one target.

7. The starter assembly of claim 6 wherein the at least one target is a magnet.

8. The starter assembly of claim 4 wherein the magnetic flux sensor is a Hall effect sensor.

9. The starter assembly of claim 4 further comprising a field frame assembly that includes the magnetic field source and circumscribes the armature and wherein the magnetic flux sensor comprises an inductive loop supported on the field frame assembly proximate the armature.

10. The starter assembly of claim 9 wherein the inductive loop defines an axial length and a circumferential width wherein the axial length is larger than the circumferential width and wherein the armature has a plurality of teeth defining slots therebetween, the slots defining a circumferential gap wherein the circumferential width of the inductive loop is approximately the same as the circumferential gap of the slots.

11. The starter assembly of claim 1 wherein the speed sensor assembly comprises an optical sensor.

12. The starter assembly of claim 1 wherein the armature includes a commutator and that starter assembly includes a plurality of brushes in contact with the commutator and wherein the speed sensor assembly comprises an auxiliary brush in contact with the commutator.

13. The starter assembly of claim 12 wherein the commutator includes at least one non-conductive element positioned to periodically face the auxiliary brush as the commutator rotates and thereby periodically break conductive contact between the auxiliary brush and commutator.

14. The starter assembly of claim 1 wherein the speed sensor assembly includes a temperature sensor and a battery voltage sensor.

15. The starter assembly of claim 1 wherein the speed sensor assembly includes a current sensor.

16. An automatic stop-start system for a vehicle having an internal combustion engine with a flywheel, comprising:

an electronic control unit;

a battery;

a starter operably coupled to the electronic control unit and the battery; the starter comprising:

a starter motor with an armature and a magnetic field source wherein the armature includes a commutator disposed at one end thereof;

a field frame assembly including the magnetic field source and circumscribing the armature;

a pinion gear drivingly coupled with the armature wherein the pinion gear and commutator are disposed on opposite axial ends of the armature and wherein the pinion gear is selectively engageable with the flywheel;

an internal power train including the armature and the pinion gear and extending therebetween wherein the internal power train transmits torque from the armature to the pinion gear;

a gear set disposed in the internal power train and dividing the internal power train into first and second segments wherein the first segment includes the armature and the second segment includes the pinion gear and wherein, during rotation of the internal power train by the starter motor, the first segment defines a first rotational speed and the second segment defines a second rotational speed less than the first rotational speed; and a speed sensor assembly configured to sense the rotational speed of the first segment and communicate a signal representative of the rotational speed to the electronic control unit, the speed sensor assembly being supported on the field frame assembly proximate the commutator.

17. The automatic start-stop system of claim 16 wherein the speed sensor assembly is configured to sense the rotational speed of the armature.

18. The starter assembly of claim 17 wherein the speed sensor assembly comprises a magnetic flux sensor.

19. The starter assembly of claim 17 wherein the speed sensor assembly comprises an auxiliary brush in contact with the commutator.

20. The starter assembly of claim 19 wherein the commutator includes at least one non-conductive element positioned to periodically face the auxiliary brush as the commutator rotates and thereby periodically break conductive contact between the auxiliary brush and commutator.

* * * * *